US005547370A

United States Patent [19]

Hwang

[11] Patent Number: 5,547,370

[45] Date of Patent: Aug. 20, 1996

[54] SAFETY STRIKER WHEEL ASSEMBLY FOR GAS LIGHTERS

[76] Inventor: Ing F. Hwang, No. 2, Lane 22, Sec. 2, Rd., Shan-Shi, Taichung, Taiwan

[21] Appl. No.: 527,302

[22] Filed: Sep. 12, 1995

[51] Int. Cl.[6] ..... F23Q 1/02

[52] U.S. Cl. ..... 431/276; 431/277; 431/274

[58] Field of Search ..... 431/274, 276, 431/277

[56] References Cited

U.S. PATENT DOCUMENTS 5,096,414 3/1992 Zellweger ..... 431/277

*Primary Examiner*—Carroll B. Dority
*Attorney, Agent, or Firm*—Pro-Techtor International

[57] ABSTRACT

A striker wheel assembly mounting structure including a wheel axle mounted between two upright supports at the top of a butane wheel, two driving wheels mounted around the wheel axle between the upright supports, and a striker wheel fixedly mounted around the wheel axle and disposed in contact with a spring-supported flint below and turned by the driving wheels through the wheel axle to strike the spring-supported flint in producing sparks, wherein the wheel axle is made of polygonal cross section, having two round rods at two opposite ends loosely inserted into a respective axle hole on each upright support; the driving wheels have a center through holes of bigger diameter relative to the wheel axle for passing the wheel axle, at least one center through hole of the driving wheels is a polygonal center through so arranged that the driving wheels run idle when turned without being depressed, or turned to rotate the wheel axle and the striker wheel when depressed.

3 Claims, 7 Drawing Sheets

SAFETY STRIKER WHEEL ASSEMBLY FOR GAS LIGHTERS

BACKGROUND OF THE INVENTION

The present invention relates to gas lighters, and relates more particularly to a safety striker wheel assembly for gas lighters.

Commercially available gas lighters are commonly made disposable and can be conveniently obtained from retail stores everywhere. However, because regular disposable gas lighters are available in most retail stores, children can easy obtain a disposable gas lighter for fun. In order to prevent young children from using regular disposable gas lighters for making fire, many countries have instituted regulations to enforce the installation of safety means in disposable gas lighters. FIG. 1 shows a disposable gas lighter with a safety button according to the prior art. This structure of disposable gas lighter comprises a butane well 10 covered with a top cover 11 to hold a striker wheel 12, a gas lever 13, and a flame nozzle 14. Furthermore, a safety button 15 is mounted in a hole (not shown) on the top cover 11 and disposed beneath the gas lever 13. Under normal condition, the gas lever 13 is stopped from downward movement by the safety button 15. The gas lever 13 can be depressed only when the safety button 15 is depressed. When the gas lever 13 is depressed and the striker wheel 12 is rotated, a flame is produced at the flame nozzle 14. Because of the installation of the safety button 15, the manufacturing cost of the disposable cigarette lighter is greatly increased. Furthermore, the installation of the safety button 15 is not easy because it must match with the gas lever 13 in operation.

SUMMARY OF THE INVENTION

The present invention has been accomplished under the circumstances in view. According to the present invention, the safety striker wheel assembly comprises a wheel axle mounted between two upright supports at the top of a butane wheel, two driving wheels mounted around the wheel axle between the upright supports, and a striker wheel fixedly mounted around the wheel axle and disposed in contact with a spring-supported flint below and turned by the driving wheels through the wheel axle to strike the spring-supported flint in producing sparks, wherein the wheel axle is made of polygonal cross section, having two round rods at two opposite ends loosely inserted into a respective axle hole on each upright support; the driving wheels have a center through holes of bigger diameter relative to the wheel axle for passing the wheel axle, at least one center through hole of the driving wheels is a polygonal center through so arranged that the driving wheels run idle when turned without being depressed, or turned to rotate the wheel axle and the striker wheel when depressed. Because the present invention does not increase the number of parts relative to regular disposable gas lighters but simply changes the configurations of the parts of the striker wheel assembly to achieve a safety control, the arrangement of the present invention increases little the manufacturing cost of the gas lighter.

DETAILED DESCRIPTION OF THE PREFERRED EMBODIMENT

Figure 1:
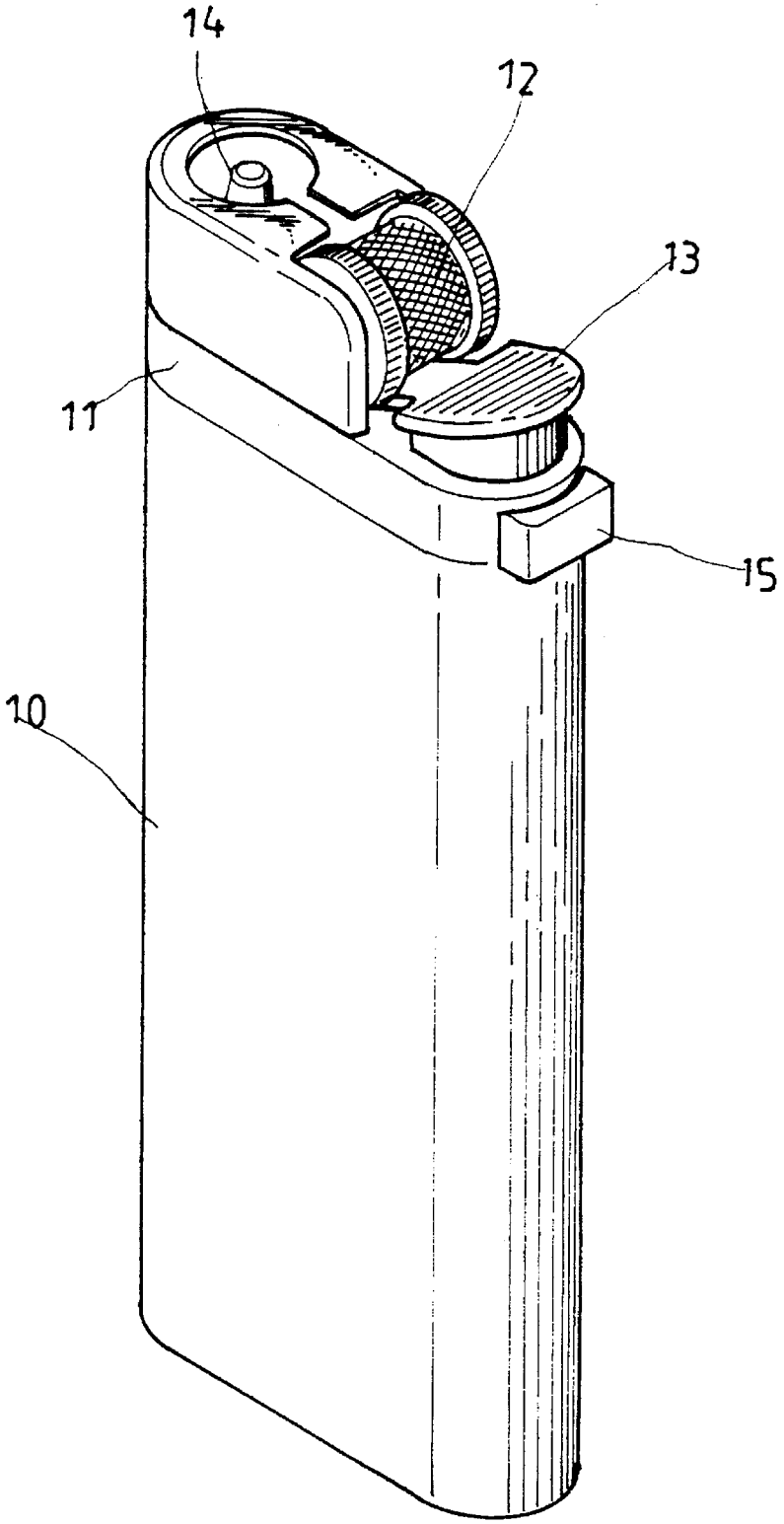
PRIOR ART FIG. 1
FIG. 1 is an elevational view of a disposable gas lighter with a safety button according to the present invention.
Figure 2:
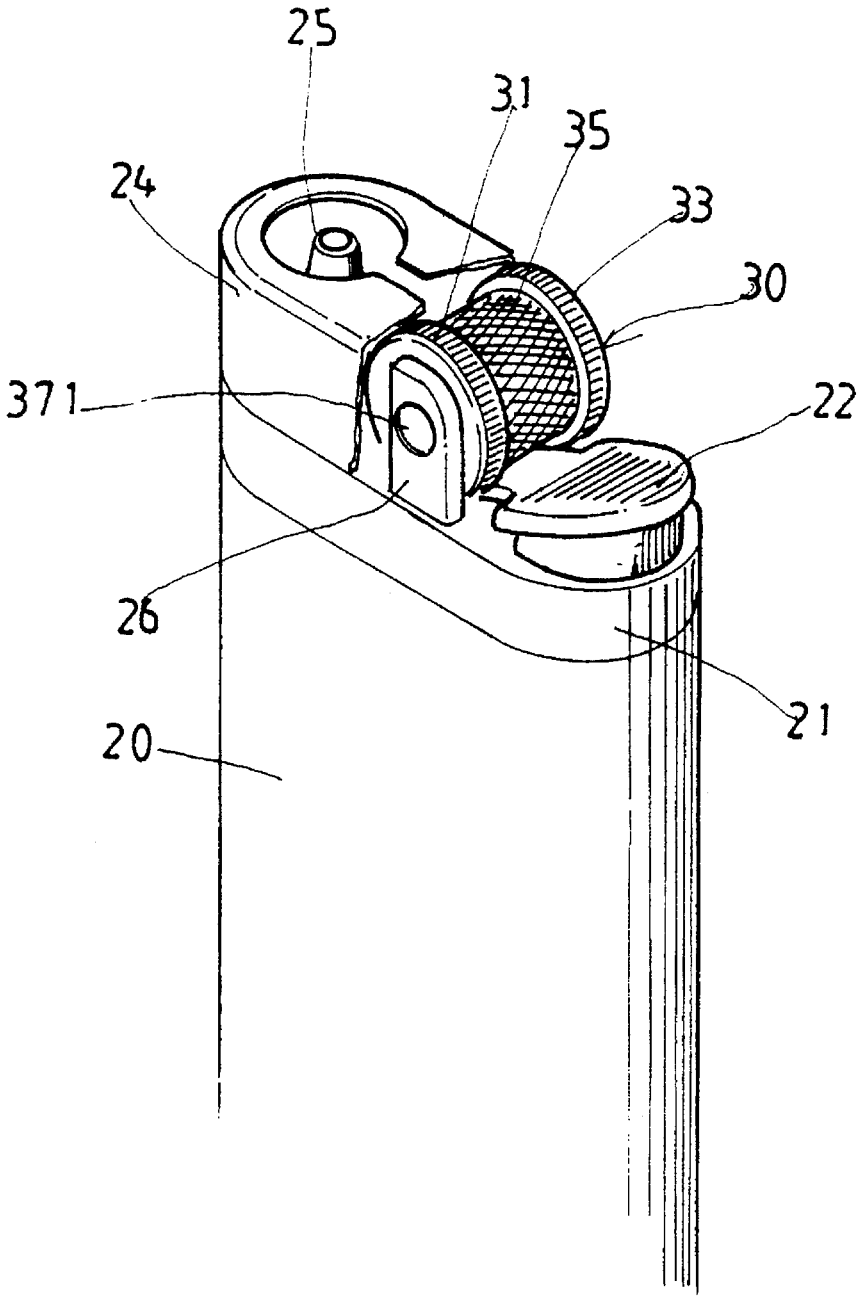
FIG. 2 is an elevational view of a disposable gas lighter according to the present invention.
Figure 3:
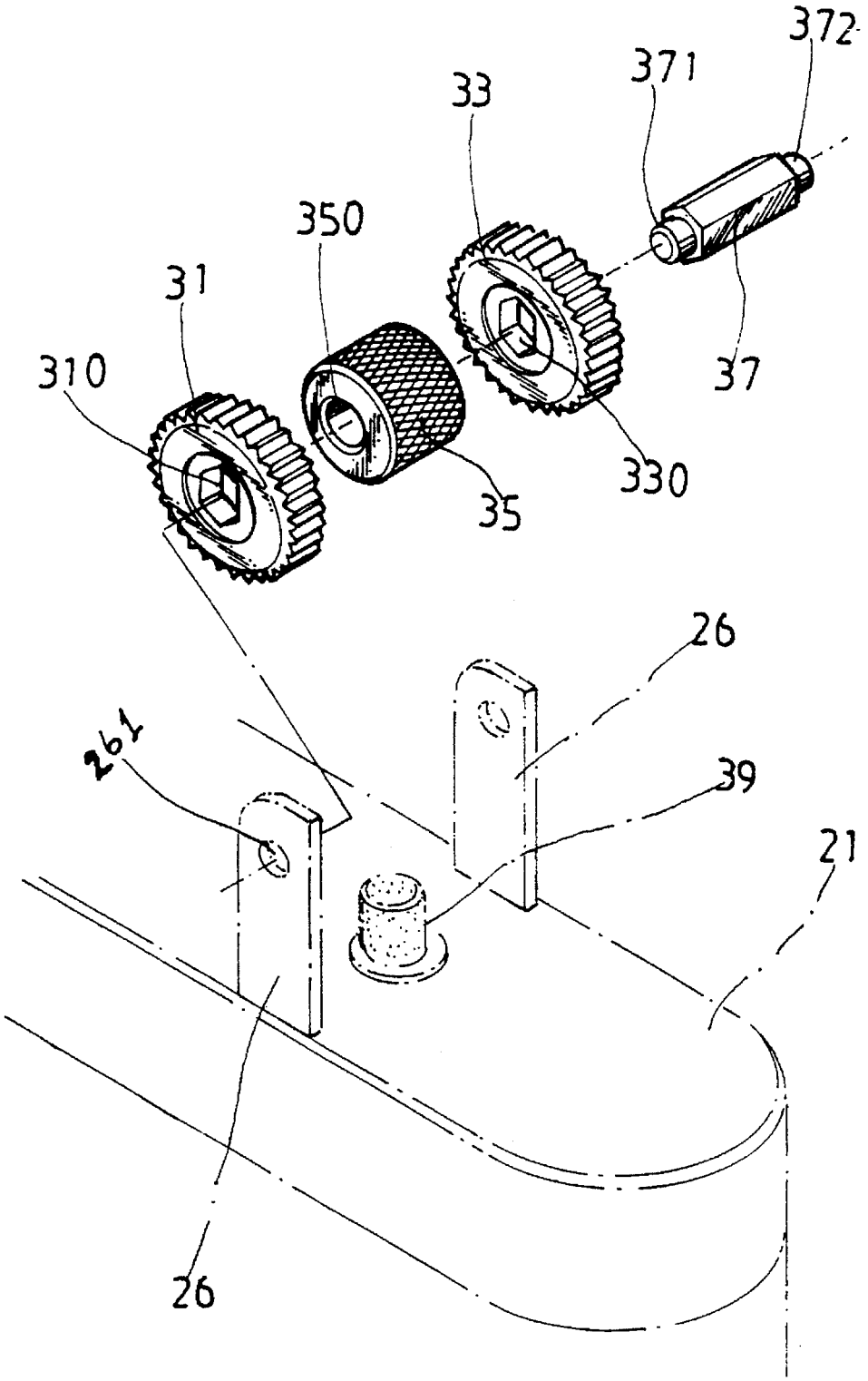
FIG. 3 is an exploded view of the safety striker wheel assembly according to the present invention.
Figure 4:
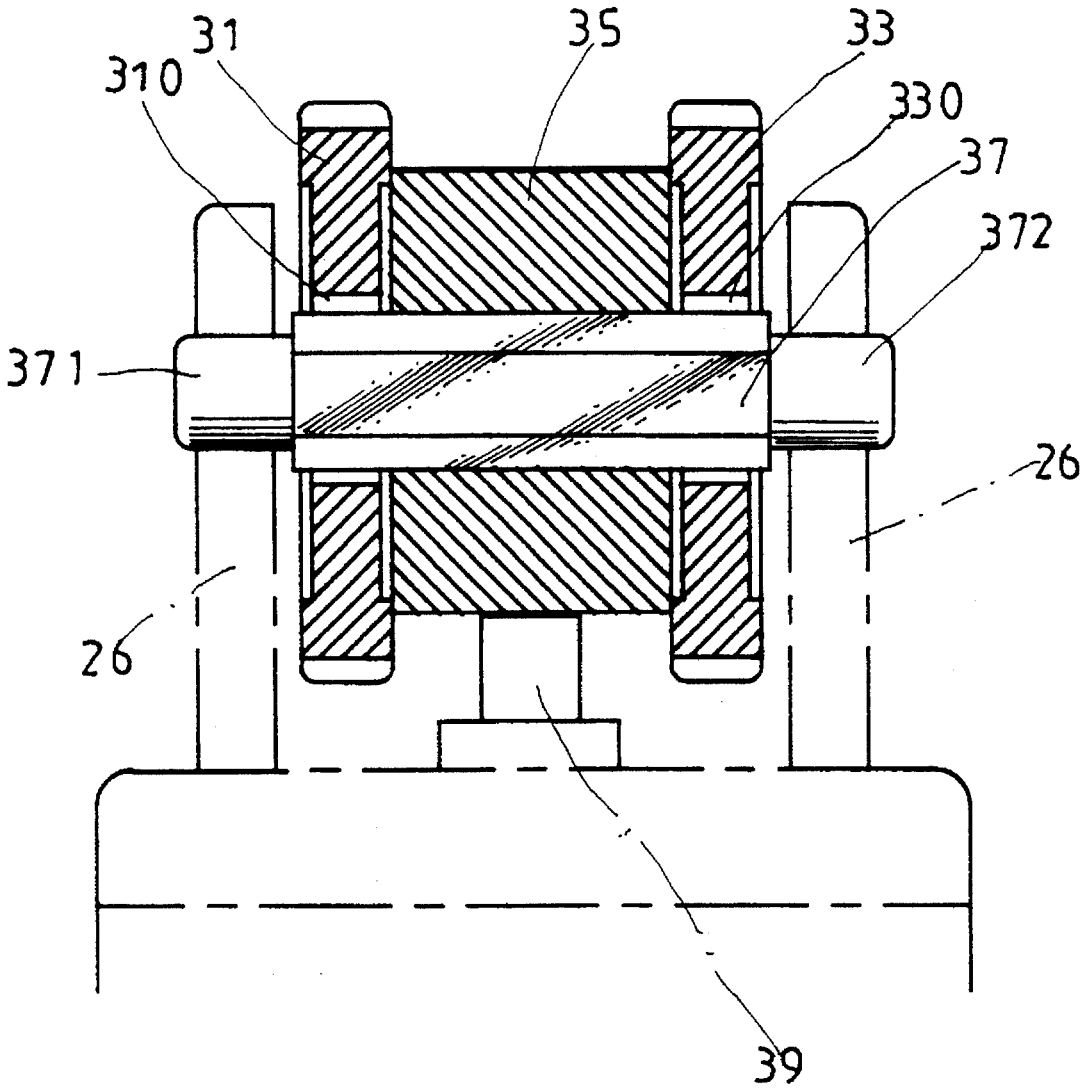
FIG. 4 is a section view showing the safety striker wheel assembly of FIG. 3 installed.

Referring to FIGS. 2, 3, and 4, a gas lever 22, a striker wheel assembly 30, a flame nozzle 25, and a metal guard 24 are respectively installed in the top 21 of a butane well 20. The striker wheel assembly 30 is revolvably mounted between two upright supports 26 on the top 21 of the butane well 20, comprised of two driving wheels 31 and 33, a striker wheel 35, and a wheel axle 37. The driving wheels 31 have a respective polygonal center through hole 310 or 330. The striker wheel 35 is retained between the driving wheels 31 and disposed in contact with a spring-supported fling 39 below, having a center through hole 350 aligned between the polygonal center through holes 310 and 330 of the driving wheels 31. The wheel axle 37 is inserted through the center through holes 330, 350, 310, having two round rods 371 and 372 respectively inserted into a respective axle hole 261 on each upright support 26. The diameter of the center through hole 350 of the striker wheel 35 is slightly smaller than that of the wheel axle 37 so that the striker wheel 35 and the wheel axle 37 are firmly retained together when the wheel axle 37 is inserted into the center through hole 350 of the striker wheel 35 by force. The cross section of the wheel axle 37 is made subject to the cross section of the polygonal center through holes 310 and 330, but of relatively smaller-size. Therefore, the wheel axle 37 can be loosely inserted into the polygonal center through holes 310 and 330. The diameter of the round rods 371 and 372 of the wheel axle 37 is slightly smaller than that of the axle holes 261 of the upright support 26, for example, the diameter of the axle holes is 2 mm and the diameter of the round rods 371 and 372 is 1.8 mm. Therefore, the wheel axle 37 can be turned in the axle holes 261. Furthermore, the polygonal center through holes 310 and 330 can be square holes, hexagonal holes, or pentagonal holes.

Figure 5:
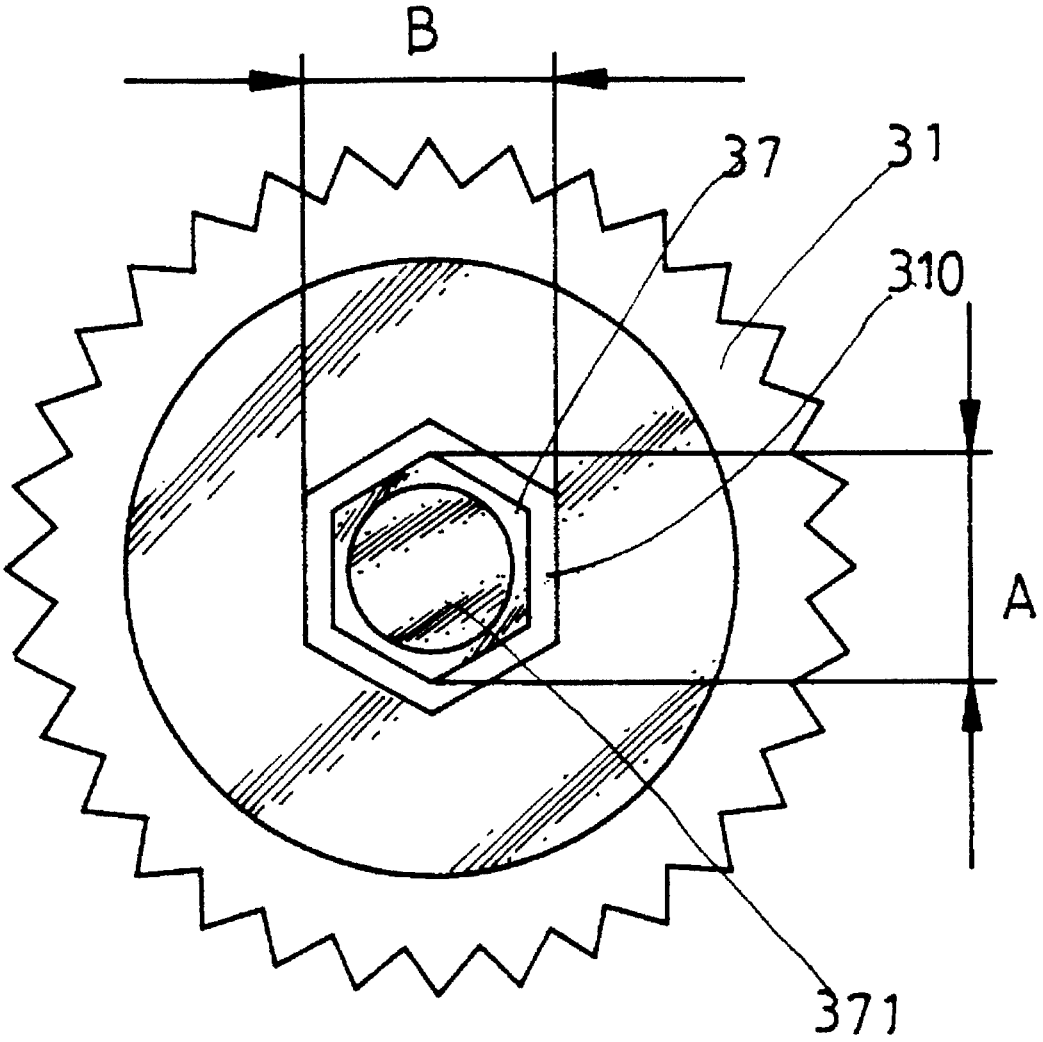
FIG. 5 is a schematic drawing showing the positioning of the wheel axle in the polygonal center through holes of the driving wheels according to the present invention.

Referring to FIG. 5, the polygonal wheel axle 37 is loosely inserted into the polygonal center through holes 310 and 330 of the driving wheels 31 and 33. If the polygonal center through holes 310 and 330 are of hexagonal through holes, the distant A between two opposite angles of the wheel axle 37 is shorter than the distance B between two opposite sides of each polygonal center through hole 310 or 330. If the distance B is 2.6 mm, the distance A is shorter than 2.6 mm. Preferably, the distance A is 2.5 mm when the distance B is 2.6 mm. Therefore, there is an eccentric throw difference about 0.25 mm.

Figure 6:
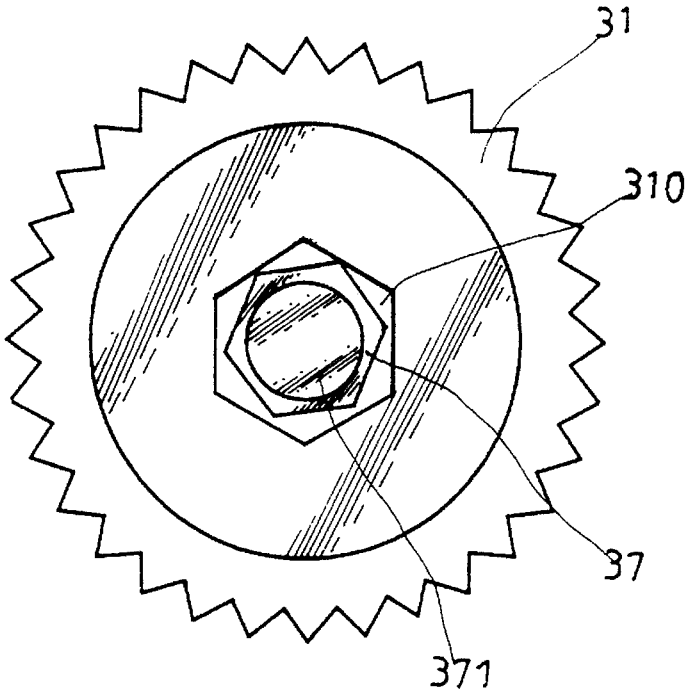
FIG. 6 shows the normal contact between the polygonal cross section of the wheel axle and the polygonal center through holes of the driving wheel according to the present invention.
Figure 8:
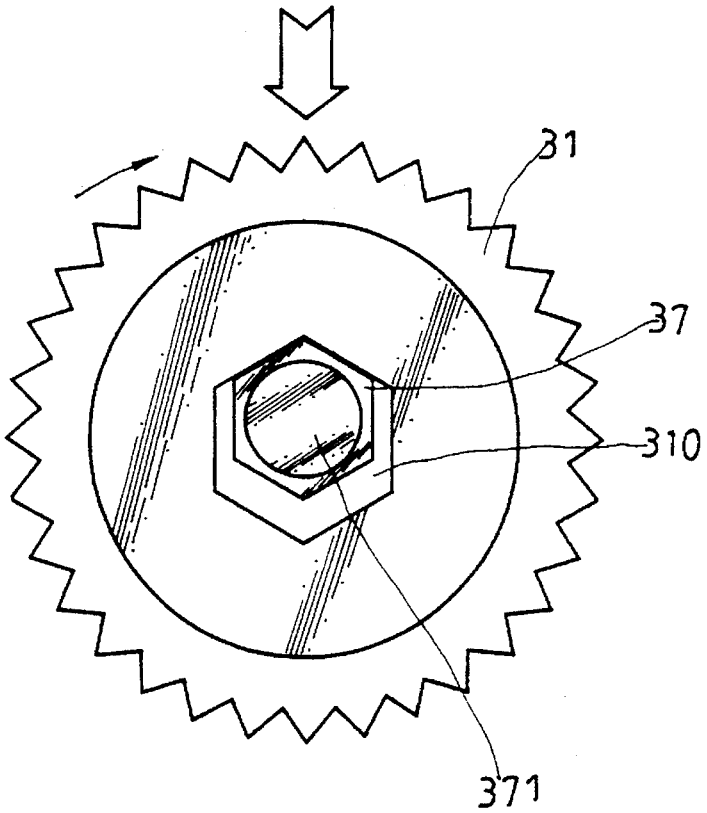
FIG. 8 shows the driving wheels depressed into engagement with the wheel axle and turned according to the present invention.
Figure 7:
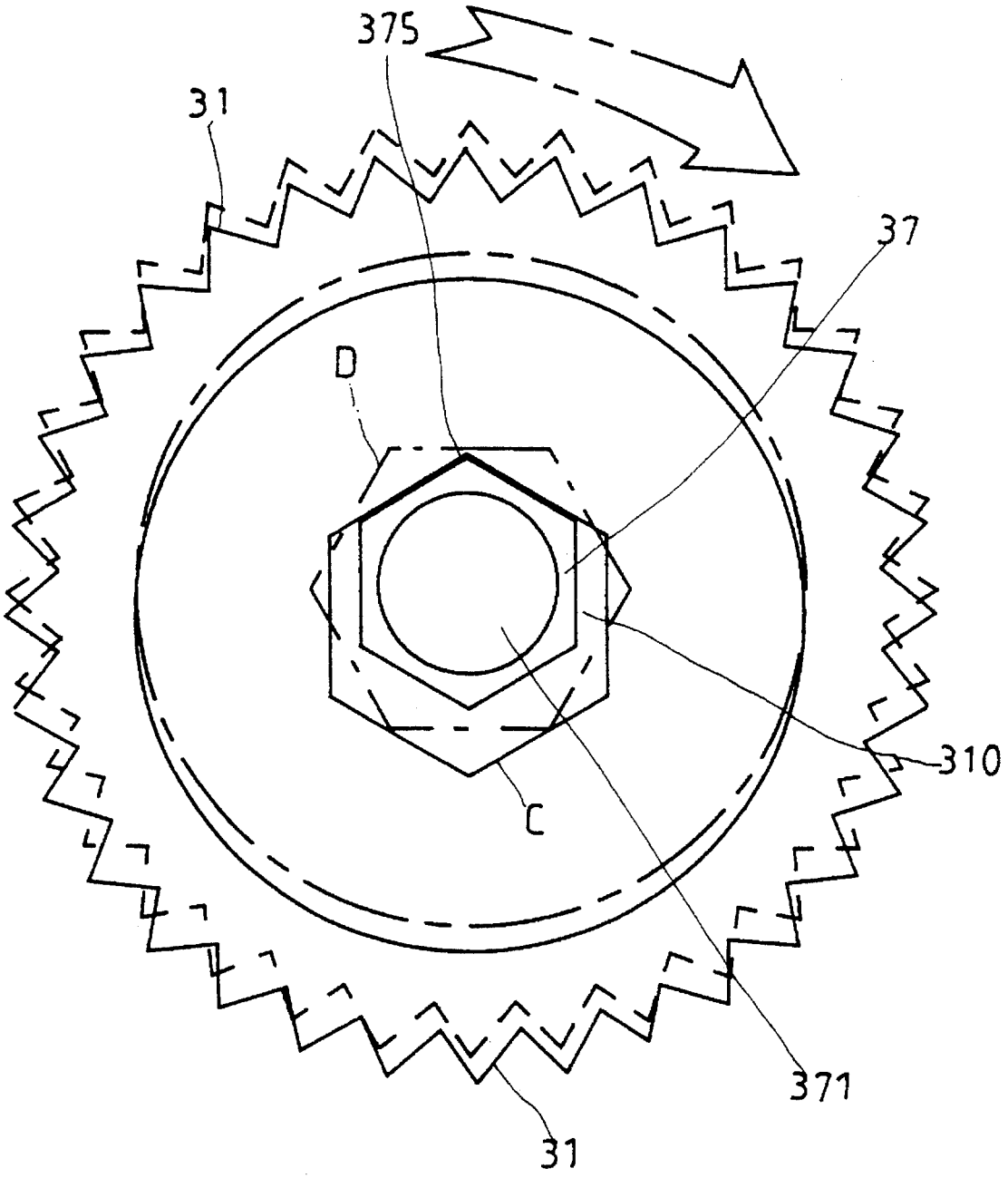
FIG. 7 shows the idle running of the driving wheels relative to the wheel axle according to the present invention.

Referring to FIGS. 6, 7, and 8, and FIG. 4 again, as indicated, the spring-supported flint 39 is supported on a spring (not shown), the round rods 317 and 372 are loosely inserted into the axle holes 261 of the upright supports 26, and the wheel axle 37 is loosely inserted in the polygonal center through holes 310 and 330 of the driving wheels 31 and 33. If the driving wheels 31 and 33 are turned by a striking force which passes through the periphery of the driving wheels 31 and 33 as shown in FIG. 7, the driving wheels 31 and 33 are guided by the contact angle 375, causing the polygonal center through holes 310 and 330 moved from the position of the real line C to the position of the imaginary line D, therefore the driving wheels 31 and 33 run idle, and the striker wheel 35 does no work when the driving wheels 31 and 33 are depressed and then turned, as shown in FIG. 8, the periphery of the polygonal center through holes 310 and 330 of the driving wheels 31 and 33 are forced into engagement with the periphery of the wheel axle 37 and turned to rotate it, causing the striker wheel 35 to strike the flint 39 in producing sparks. When the driving wheels 31 and 33 are released, the spring-supported fling 39 forces the striker wheel 35 and the wheel axle 37 back to their former positions, and therefore the driving wheels 31 and 33 are returned to the safety (idle) position as shown in FIG. 6.

As the aforesaid members are commonly used in regular disposable gas lighters but simply made of different outer diameter or inner diameter, the manufacturing of the present invention is easy and inexpensive.

It is to be understood that the drawings are designed for purposes of illustration only, and are not intended as a definition of the limits and scope of the invention disclosed.

I claim:

1. A safety striker wheel assembly comprising a wheel axle mounted between two upright supports at the top of a butane reservoir, two driving wheels mounted around said wheel axle between said upright supports, and a striker wheel fixedly mounted around said wheel axle and disposed in contact with a spring-supported flint below and turned by said driving wheels through said wheel axle to strike said spring-supported flint in producing sparks, wherein said wheel axle is made of polygonal cross section, having two round rods at two opposite ends loosely inserted into a respective axle hole on each upright support; said driving wheels have a center through holes of bigger diameter relative to said wheel axle for passing said wheel axle, at least one center through hole of said driving wheels is a polygonal center through so arranged that said driving wheels run idle when turned without being depressed, or turned to rotate said wheel axle and said striker wheel when depressed.

2. The safety striker wheel assembly of claim 1 wherein the center through holes of said two driving wheels are of polygonal shape corresponding to the configuration of the polygonal cross section of said wheel axle.

3. The safety striker wheel assembly of claim 1 wherein the distance between two opposite sides of said wheel axle is shorter than the distance between two opposite sides of the polygonal center through hole of each driving wheel.

* * * * *